US006198050B1

(12) United States Patent
Blalock

(10) Patent No.: US 6,198,050 B1
(45) Date of Patent: Mar. 6, 2001

(54) CONDUIT BOX ASSEMBLY FOR LARGE ELECTRIC MOTOR

(75) Inventor: Christopher A. Blalock, Ellenboro, NC (US)

(73) Assignee: Reliance Electric Technologies, LLC, Thousand Oaks, CA (US)

( * ) Notice: Subject to any disclaimer, the term of this patent is extended or adjusted under 35 U.S.C. 154(b) by 0 days.

(21) Appl. No.: 09/160,759

(22) Filed: Sep. 25, 1998

(51) Int. Cl.[7] ..... H01R 4/00
(52) U.S. Cl. ..... 174/88 B; 174/99 B
(58) Field of Search ..... 174/88 B, 96, 174/97, 98, 99 B, 129 B, 131 R, 133 B, 70 B, 71 B, 72 B

(56) References Cited

U.S. PATENT DOCUMENTS

| | | | | |
|---|---|---|---|---|
| 2,356,006 | * | 8/1944 | Samer | 174/99 B |
| 2,430,557 | * | 11/1947 | Carlson | 174/71 B |
| 2,916,177 | | 12/1959 | Nottelmann et al. . | |
| 3,004,096 | * | 10/1961 | Rowe | 174/88 B |
| 3,187,086 | * | 6/1965 | Moodie et al. | 174/68.2 |
| 3,189,680 | * | 6/1965 | Stanback | 174/88 B |
| 3,383,458 | * | 5/1968 | Raskhodoff et al. | 174/72 B |
| 3,559,148 | * | 1/1971 | Hafer | 439/213 |
| 3,609,215 | * | 9/1971 | Giger, Jr. | 174/88 B |
| 3,636,237 | * | 1/1972 | Hafer | 174/68.3 |
| 4,492,886 | | 1/1985 | Bar . | |
| 4,590,397 | | 5/1986 | Davis . | |
| 4,599,484 | | 7/1986 | Bramwell . | |
| 4,754,179 | | 6/1988 | Capuano et al. . | |
| 5,223,671 | | 6/1993 | Alfieri . | |
| 5,543,581 | | 8/1996 | Kurata et al. . | |

* cited by examiner

*Primary Examiner*—Kristine Kincaid
*Assistant Examiner*—Dhiru R Patel
(74) *Attorney, Agent, or Firm*—Craig N. Killen; John J. Horn; A. M. Gerasimow

(57) ABSTRACT

An improved conduit box assembly for a large electric motor permits placement of busbar units and other such components at various locations therein. The conduit box has a main box in which fixed mounting bases are installed. Preferably, four L-shaped mounting bases are provided, one located in each of the respective corners. The mounting bases are configured to permit attachment of removable terminal support members on which the busbar units or other components are carried. Each terminal support member is mounted in a desired location within the main box across a pair of opposed base elements. Preferably, the support members can be placed in any one of a plurality of rotational and axial positions.

3 Claims, 7 Drawing Sheets

CONDUIT BOX ASSEMBLY FOR LARGE ELECTRIC MOTOR

BACKGROUND OF THE INVENTION

The present invention relates generally to the art of large electric motors. More particularly, the invention relates to an improved conduit box assembly for use with a large electric motor.

Electric motors, particularly high horsepower electric motors of the type used to power industrial machinery, often have relatively large conduit boxes mounted to the motor housing. Inside the conduit box, connections are made between power leads from the motor and feed wires from a source of electricity. Typically, this electrical connection has been made at standoff bus bars mounted to a rigid base inside the conduit box.

In the past, the base to which the bus bars are attached has been fixed in place at the time the conduit box is manufactured. Thus, the relative position of the bus bars could not be changed to meet various situations that might arise. Instead, it has often been necessary to permanently modify the existing conduit box, or provide another conduit box specifically made for the particular situation.

SUMMARY OF THE INVENTION

The present invention recognizes and addresses the foregoing considerations and others of prior art constructions and methods. Accordingly, it is an object of the present invention to provide an improved conduit box assembly for a large electric motor.

It is a further object of the present invention to provide an improved conduit box assembly yielding enhanced versatility in the placement of electrical terminal units.

It is a more particular object of the present invention to provide an improved conduit box assembly in which electrical terminal units can be placed in any one of a plurality of axial and/or rotational positions.

It is a more particular object of the present invention to provide an improved conduit box assembly in which a variety of accessories can be easily installed.

Some of these objects are achieved by a conduit box assembly for use with a large electric motor. The assembly comprises a main box defining an interior cavity. A mounting structure is also provided, adapted for mounting the main box to a housing of the electric motor. At least one pair of opposed mounting base elements are fixedly mounted on an inside of the main box. A terminal support member is adapted to be removably mounted across the opposed mounting base elements.

In some exemplary embodiments, the mounting base elements have an elongate configuration and extend substantially in parallel to one another. In this case, the base elements may be configured to permit attachment of the terminal support member in any one of a plurality of axial positions.

Preferably, the base elements may be located in respective corners of the main box. For example, a total of four base elements may be provided, each located in a respective corner of the main box. In this case, the base elements may be configured to permit attachment of the terminal support member in any one of four rotational positions.

In some presently preferred embodiments, the terminal support member may carry a plurality of standoff busbar units, lightning arrestor units or surge cap units. It will often be desirable to provide multiple terminal support members, each equipped with different terminal components. For example, standoff busbar units may be mounted on one terminal support member, with lightning arrestors or surge caps being located on a second terminal support member.

Other objects of the present invention are achieved by a conduit box assembly for use with a large electric motor. The assembly comprises a main box defining an interior cavity. At least two pairs of opposed mounting base elements are fixedly mounted on an inside of the main box. A terminal support member is also provided, adapted to be removably mounted to the opposed mounting base elements in a plurality of rotational positions. Each one of the rotational positions is defined between a respective pair of the opposed mounting base elements.

In some exemplary embodiments, the two pairs of opposed base elements may comprise a total of at least three base elements. For example, the base elements may be mounted in three adjacent corners of the main box. A further base element may also be mounted in the fourth corner of the conduit box to permit attachment of the terminal support element in any one of four rotational positions.

Other objects of the present invention are achieved by a busbar assembly for use with a conduit box. The busbar assembly comprises at least two L-shaped and elongate base elements being situated in parallel to one another and spaced by a predetermined separation. A terminal support member is removably attached between the base elements. The busbar assembly further comprises a plurality of standoff busbar units attached to the terminal support member for the connection of electrical leads thereto.

In some exemplary embodiments, the elongate support member comprises an elongate support element having attachment plates located at respective ends thereof. Often the base elements will each have a plurality of connection points symmetrically spaced thereon.

Other objects of the present invention are achieved by a method of locating electrical terminals inside a conduit box in any one of a plurality of positions. One step of the method involves providing a plurality of mounting base elements at predetermined spaced apart locations in the conduit box. A terminal support member having at least one electrical terminal unit located thereon is also provided. The terminal support member is removably mounted to a pair of the mounting base elements. At least one lead wire is then attached to the electrical terminal unit.

Other objects, features, and aspects of the invention are provided by various combinations and subcombinations of the disclosed elements, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
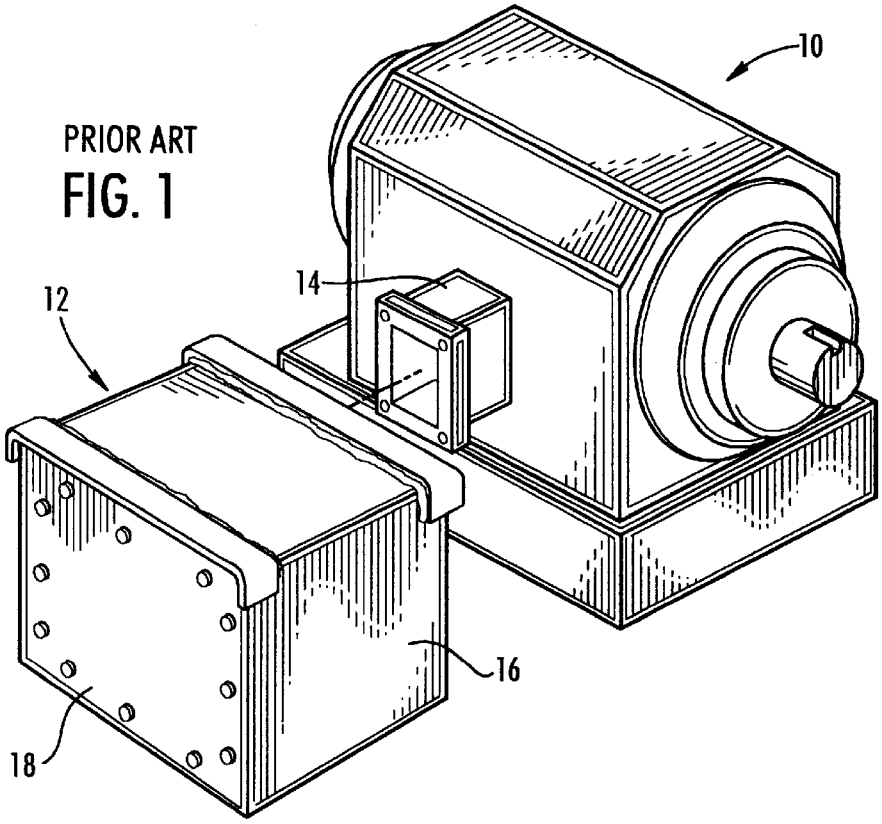
PRIOR ART FIG. 1
FIG. 1 is a perspective view of a large electric motor in conjunction with a conduit box of the prior art.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the following discussion is a description of exemplary embodiments only, and is not intended as limiting the broader aspects of the present invention, which broader aspects are embodied in the exemplary constructions.

Before discussing in detail a preferred embodiment of the present invention, the prior art will be described in greater detail. Thus, FIG. 1 shows a large electric motor 10 having a typical conduit box 12 of the prior art. Conduit box 12 is attached to the housing of motor 10 by a conventional mounting structure 14. Mounting structure 14 defines a lead wire conduit through which power leads of motor 10 pass into conduit box 12.

Figure 2A:
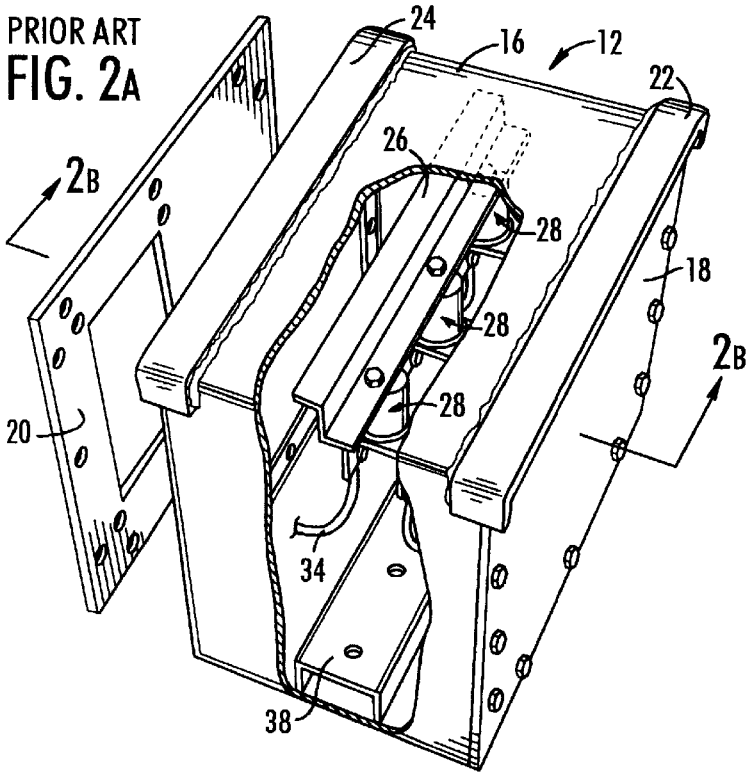
PRIOR ART FIG. 2A
FIG. 2A is a perspective view, partially exploded and cut away, of the prior art conduit box of FIG. 1.
Figure 2B:
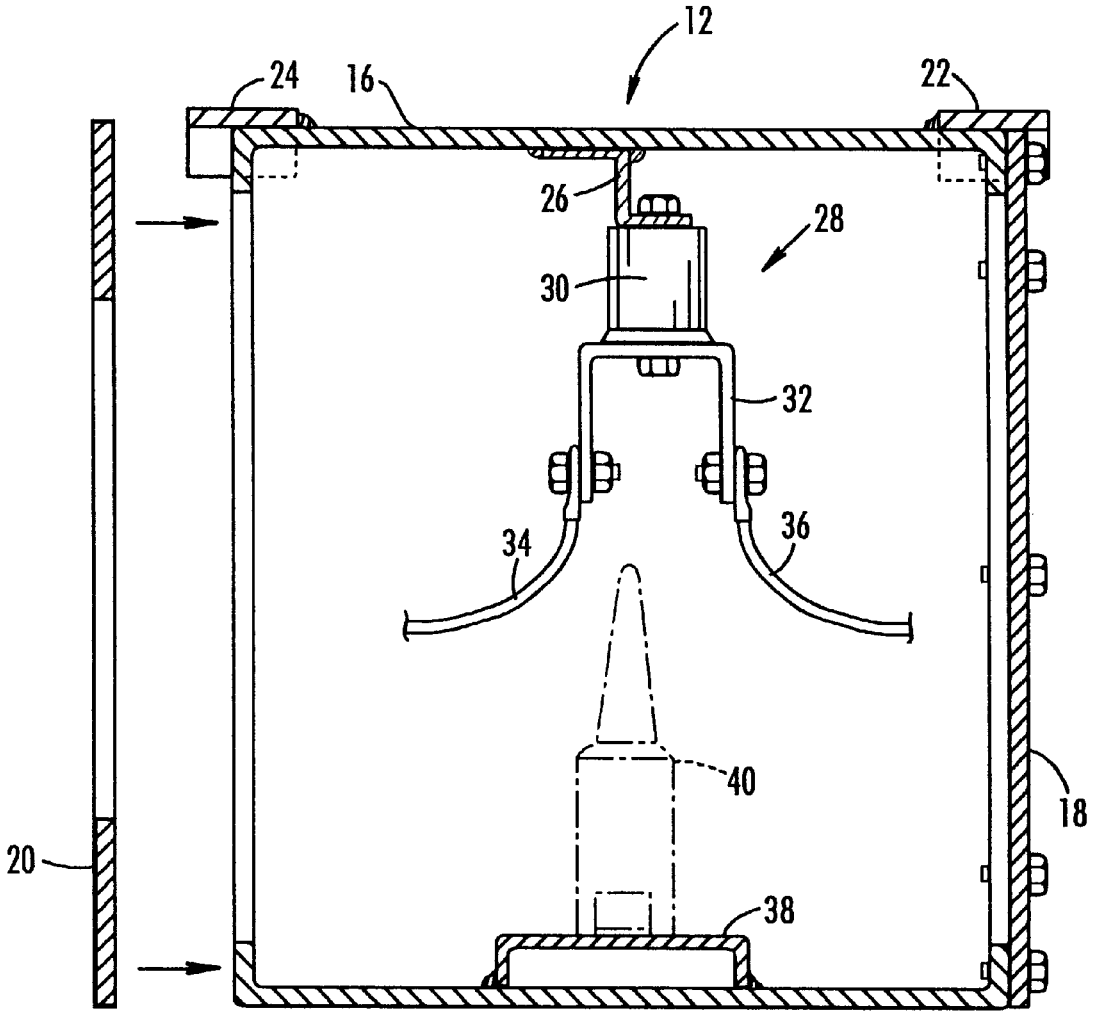
PRIOR ART FIG. 2B
FIG. 2B is a cross-sectional view taken along line 2B—2B of FIG. 2A.

Referring now to FIGS. 2A and 2B, conduit box 12 is constructed having a main box 16 to which respective front and back access panels 18 and 20 are removably attached. Panels 18 and 20 are typically attached using a series of periphery bolts engaging flanges directed inwardly from the sides of main box 16. As shown, drip guards 22 and 24 may be fixed to main box 16 above the respective interface with panels 18 and 20. Drip guards 22 and 24 serve to deflect much of the rain water and the like that could otherwise enter conduit box 12.

An elongate terminal support member 26 having an L-shaped configuration is welded as shown to the inner surface of main box 16. Support member 26 carries a plurality (typically three) of standoff busbar units 28, each of which includes an insulative standoff 30 and a U-shaped terminal element 32. As shown, a lead wire 34 from the motor is connected to one leg of terminal element 32. A power feed wire from a source of electricity is typically connected to the opposite leg of terminal element 32. Because terminal element 32 is conductive, lead wire 34 and feed wire 36, attached in this manner, are electrically connected to one another. Standoff 30 serves to electrically isolate terminal element 32 from the remainder of conduit box 12.

Depending on the requirements of a particular application, various accessory devices may also be located inside of conduit box 12. For example, different implementations may also utilize lightning arrestors or surge caps. In this case, one or more additional terminal support members, such as support member 38, may be fixed on the inside surface of main box 16. As shown, support member 38 is configured as a U-shaped element, invertedly mounted to provide a platform for the desired accessory device (as shown in phantom at 40).

The prior art arrangement is effective for providing electrical connection points. As described above, however, it is not without disadvantages. For example, the desired location of the terminal support member will often change depending on the exigencies of a particular application. Since terminal support members 26 and 38 are welded to main box 16, a reorientation of these elements cannot be easily accomplished. Often, it is necessary to simply provide a new conduit box made to the desired specifications.

Figure 3:
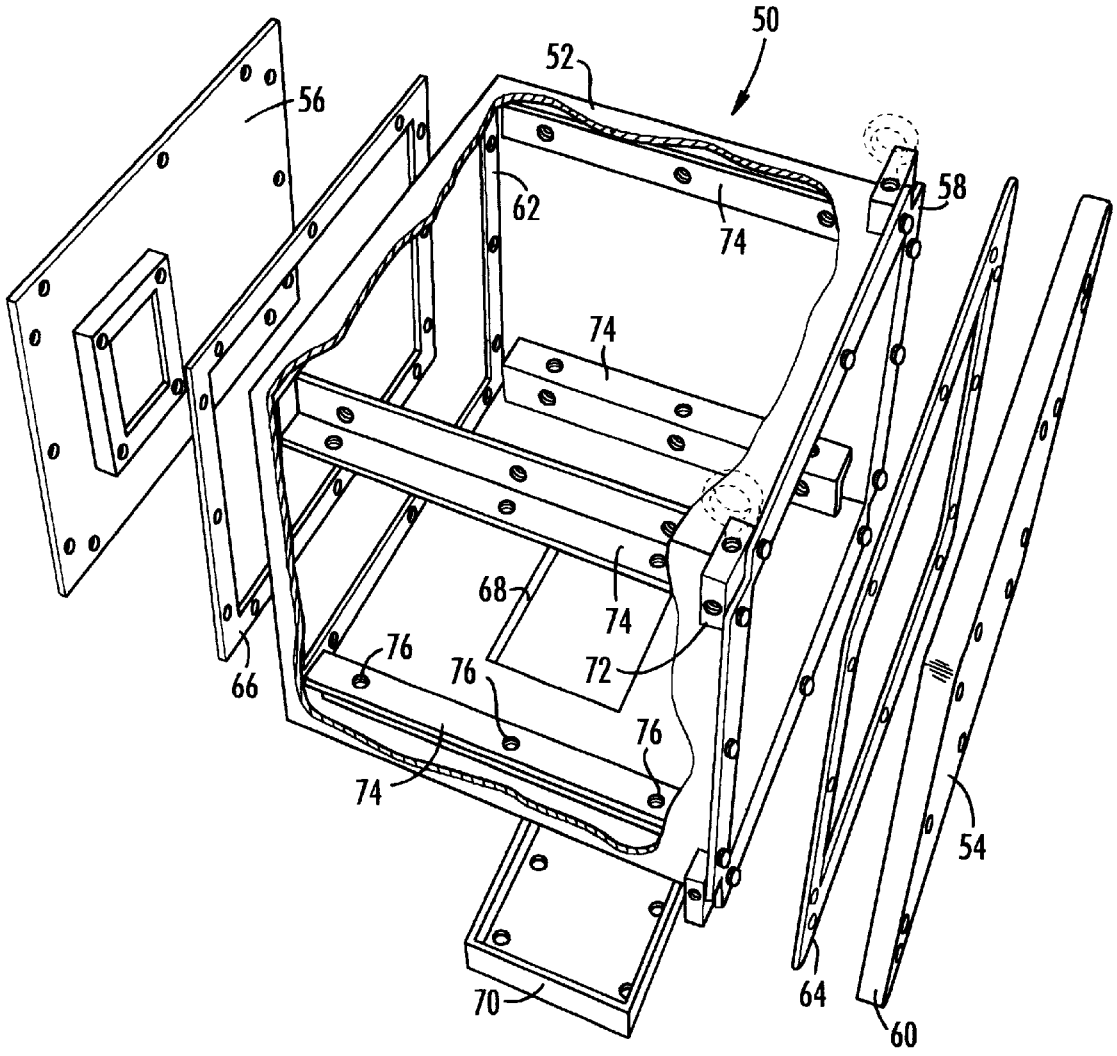
FIG. 3 is an exploded perspective view, partially cut away, of a conduit box made in accordance with the present invention.

Referring now to FIG. 3, a conduit box 50 of the present invention will be described. As shown, conduit box 50 preferably comprises a main box 52 to which respective front and back panels 54 and 56 are removably attached, such as by suitable bolts. In this case, front panel 54 is attached to a flange 58 extending outwardly from the interior of main box 52. A perimeter lip 60 extends integrally from the main surface of front panel 54 to surround flange 58 when front panel 54 is attached. Back panel 56 is attached to an inwardly directed flange 62, which may take the form of a recessed seat into which back panel 56 is received. Gaskets 64 and 66 may be provided at the respective interfaces where panels 54 and 56 are joined to main box 52, thus enhancing resistance to water penetration at these locations.

In the illustrated embodiment, conduit box 50 is constructed to be water-resistant in a plurality of angular orientations. In other words, main box 50 can be attached to back panel 56 in any one of four rotated positions without resulting in substantially increased water penetration. This may be desirable, for example, to position feed wire opening 68 in a desired location. In many prior art arrangements, fixed drip guards prevented such reorientation of the conduit box.

Certain additional aspects of conduit box 50 will now be described. As shown, a water-resistant cover 70 may be provided over opening 68. In addition, corner brackets, such as bracket 72, may be provided in each corner of main box 50. In addition to giving main box 52 enhanced stiffness, the brackets may threadingly receive eyebolts or the like. The eyebolts provide a location at which conduit box 50 can be easily lifted.

Figure 4:
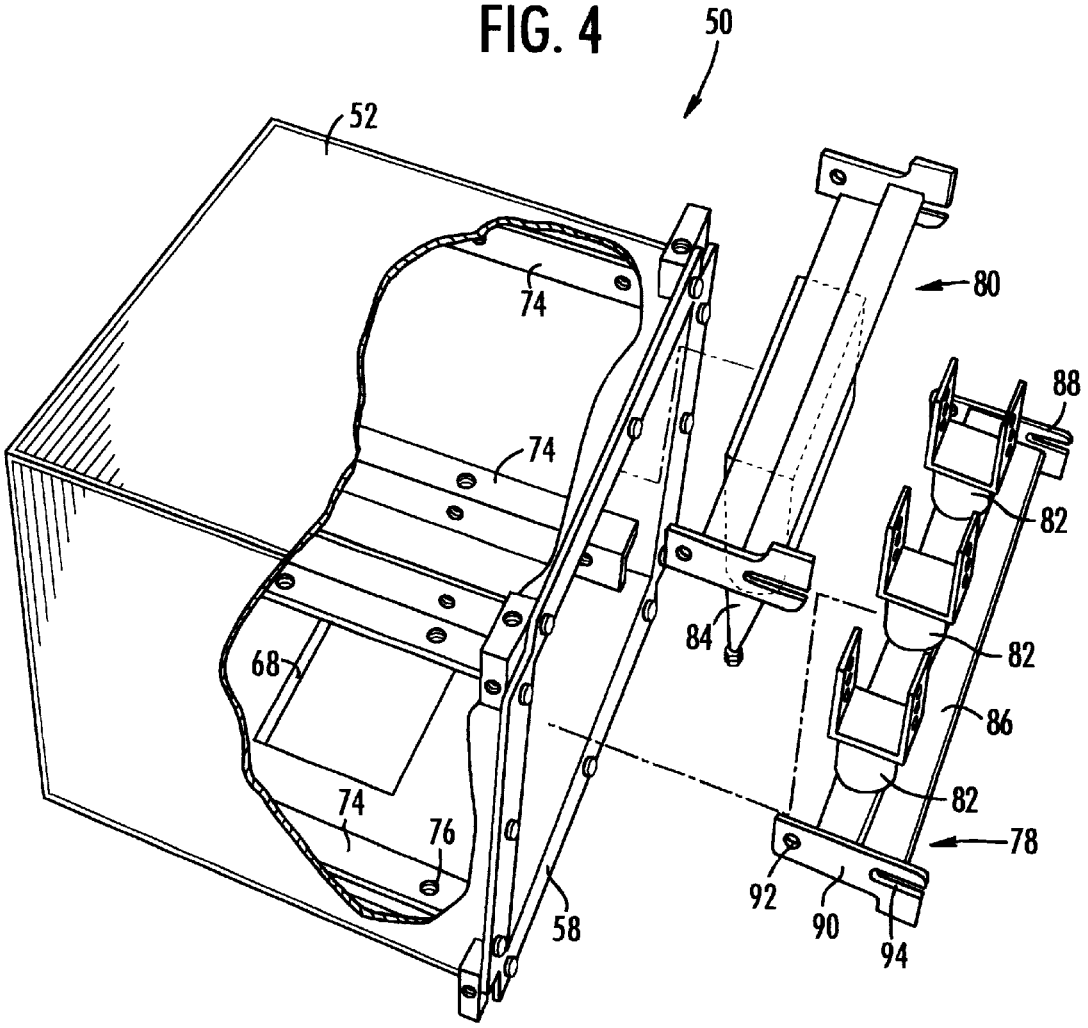
FIG. 4 is a perspective view, partially cut away, of a conduit box of the present invention illustrating a pair of terminal support members that may be installed therein.

Unlike the prior art arrangement discussed above, conduit box 50 provides significant flexibility in the placement of electrical terminal units and various accessory devices. Referring now also to FIG. 4, conduit box 50 includes a plurality of mounting base elements arranged in parallel pairs. For example, four base elements 74 may be provided, one in each corner of main box 52. Base elements 74 are welded or otherwise suitably fixed to the inside surface of main box 52.

In this case, base elements 74 are L-shaped so that the intersection of the two legs of the "L" forms a ninety-degree angle. A plurality of threaded holes, such as holes 76, are drilled into each leg of a base element. Preferably, the threaded holes are symmetrically arranged such that holes of opposed legs will be aligned. In the illustrated embodiment, three threaded holes are drilled into each leg, yielding a total of six holes in each of base elements 74.

The electrical terminal units and other accessories are carried on removable terminal support members, such as support members 78 and 80. In this case, support member 78 carries a trio of standoff busbar units 82 having a construction like those of the prior art. Support member 80 similarly carries a surge cap unit 84 having three surge capacitors.

As shown, each support member includes an elongate support bar, such as support bar 86, having attachment plates located on each end thereof, such as those indicated at 88 and 90. In the illustrated embodiment, the support bars may be made from a length of "z-bar" stock.

Each of the support members is sized to extend across the space between a pair of parallel base elements 74. In the illustrated embodiment, the support members will be located entirely between opposed legs of the associated base element pair. At least one hole (such as hole 92) or slot may be defined in each attachment plate to align with a threaded hole in the adjacent base element 74. Optionally, a second hole or slot (such as slot 94) may be also be defined in the attachment plate for alignment with a second threaded hole in the base element leg.

Figure 5A:
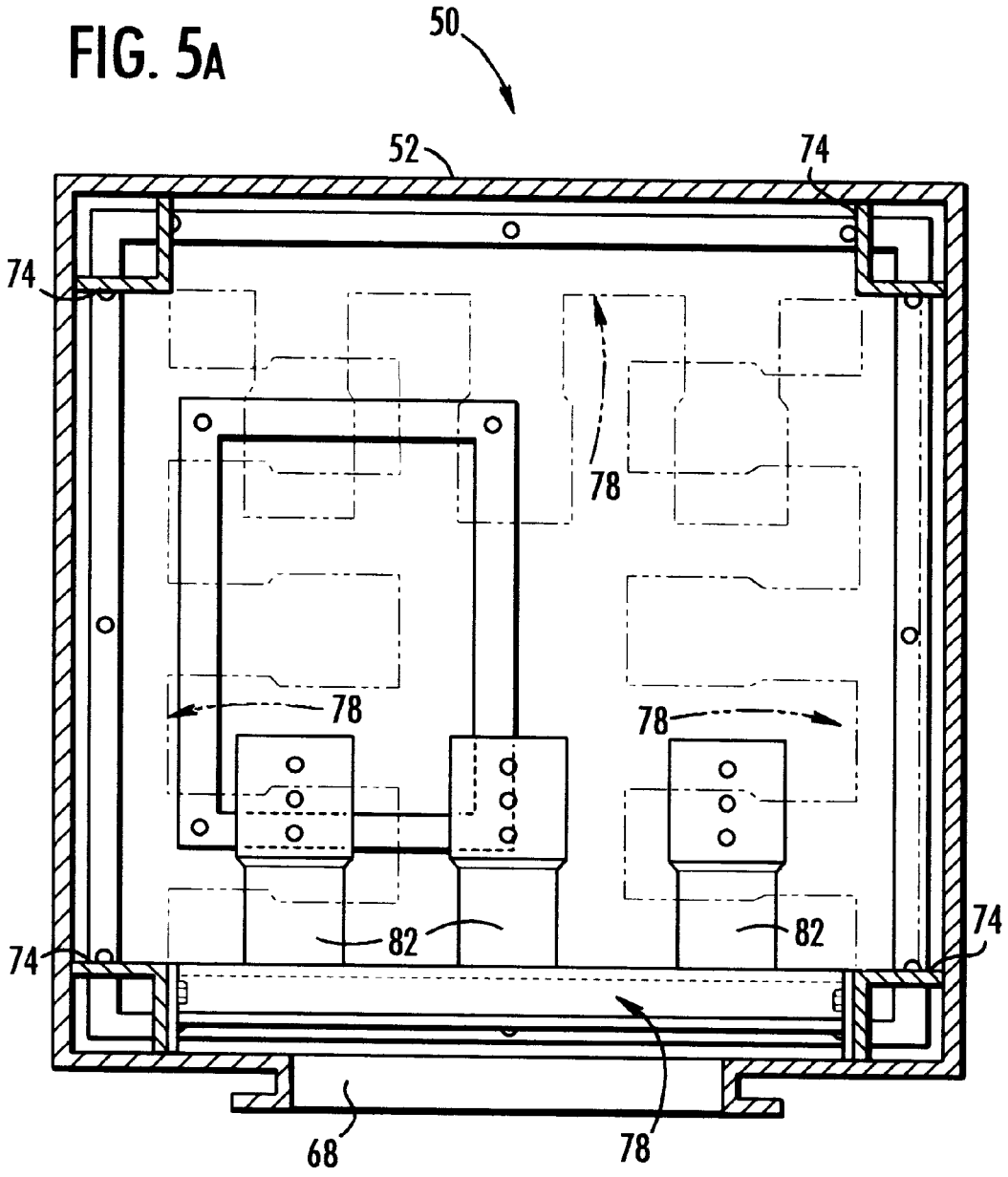
FIG. 5A is a cross-sectional frontal view of a conduit box constructed in accordance with the present invention, illustrating a plurality of rotational positions in which a terminal support member may be located.

With base elements 74 being located in all four corners, six threaded holes in each will yield eight different mounting positions for a terminal support member. In other words, the terminal support member can be located in any one of four "rotational" positions, i.e., 90°, 180°, 270° and 360°, as shown in FIG. 5A. In each of these rotational positions, the terminal support member can be located in either of two "axial" positions, i.e., either nearer or farther from front panel 54. It will be appreciated that such an arrangement gives dramatically greater flexibility than could be achieved with the prior art discussed above.

Figure 5B:
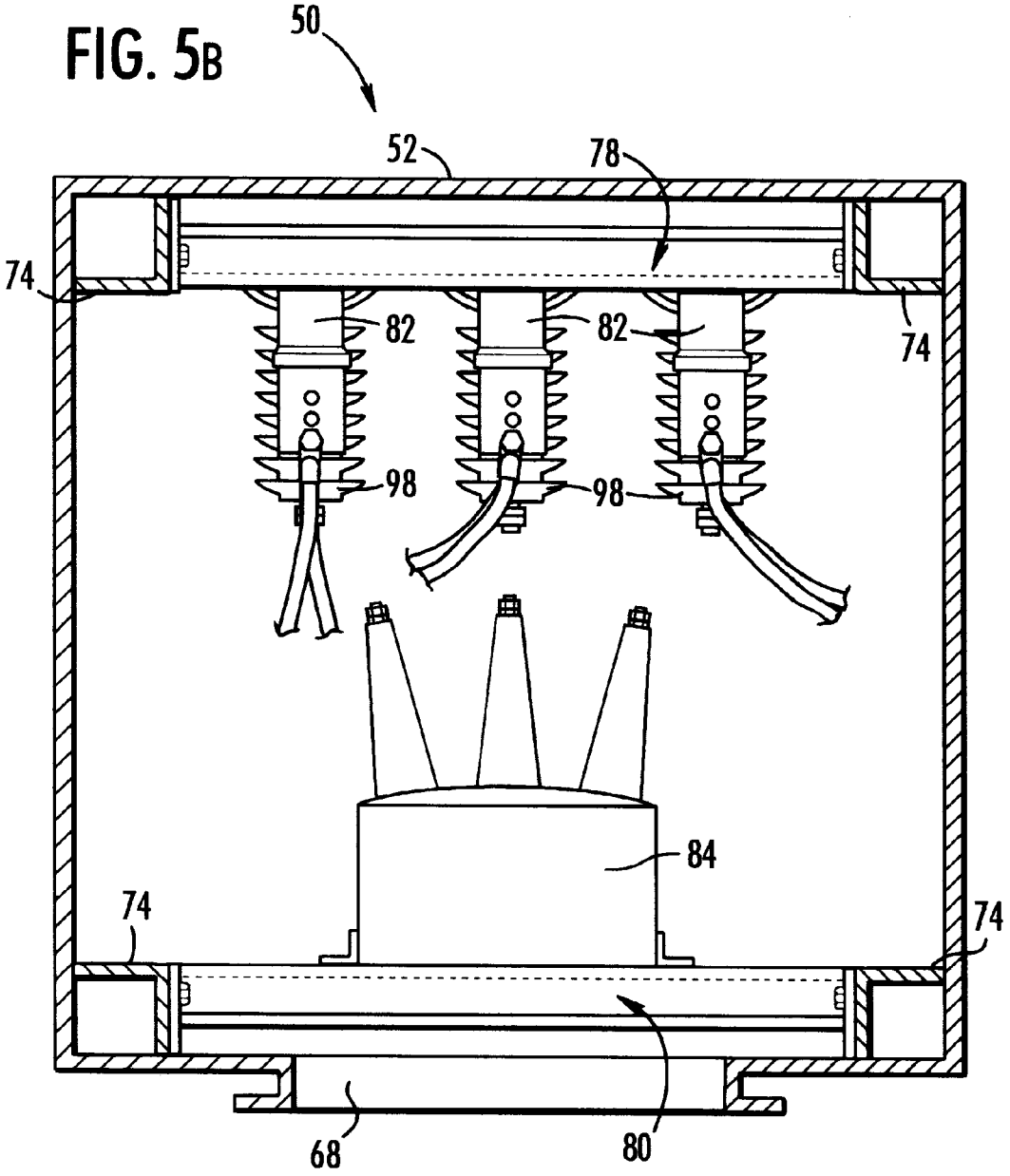
FIG. 5B is a cross-sectional frontal view similar to FIG. 5A illustrating the placement of multiple support members therein.
Figure 5C:
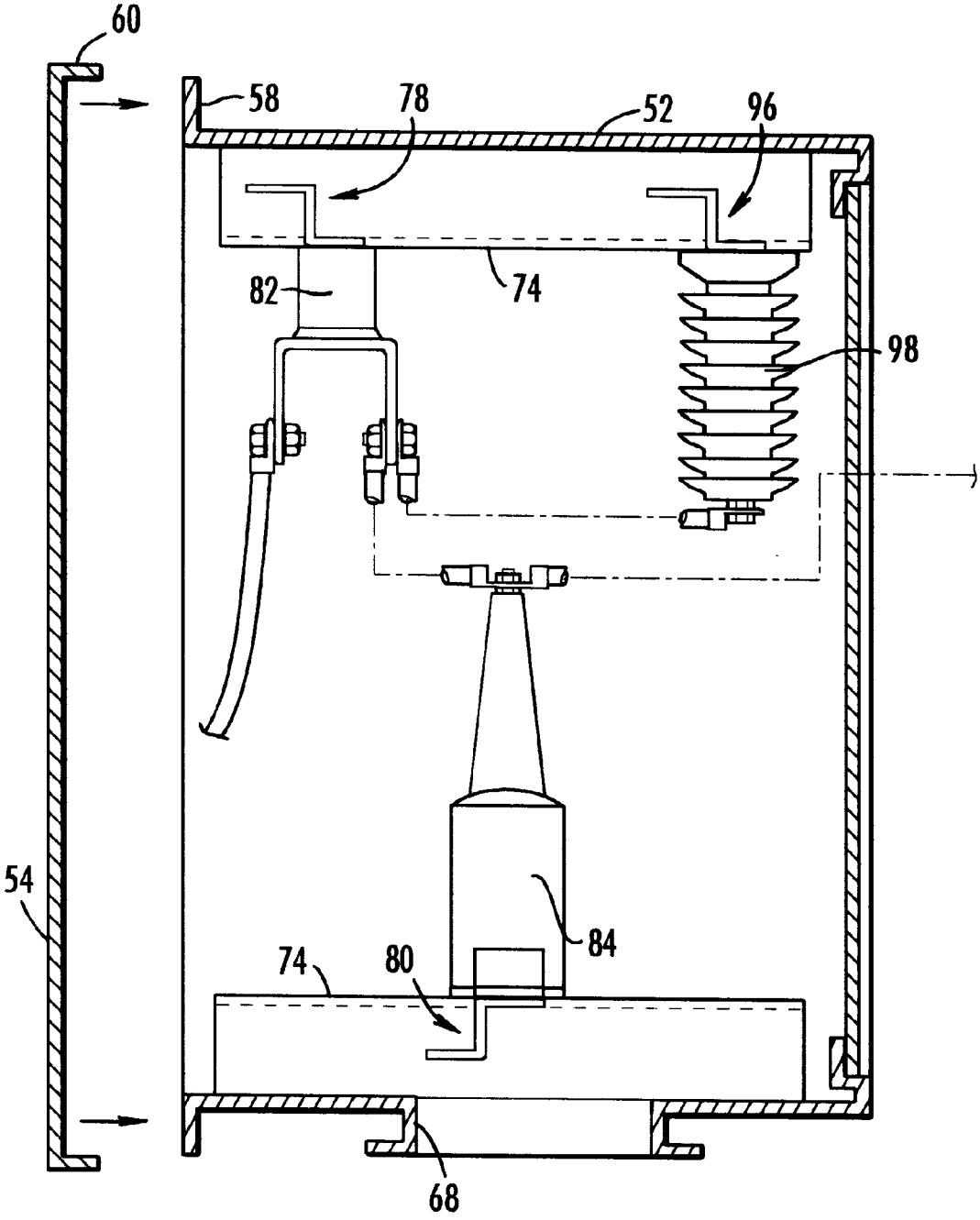
FIG. 5C is a cross-sectional side view of the embodiment shown in FIG. 5B.

Referring now to FIGS. 5B and 5C, support elements 78 and 80 are positioned in the top and bottom, respectively, of main box 52. An additional support member 96 is also provided in this case to maintain a plurality of lightning arrestors 98. It will be appreciated that each of terminal support members 78, 80 and 96 are independently moveable for greatest flexibility.

It can thus be seen that the present invention provides an improved conduit box assembly in furtherance of the noted objects. While preferred embodiments of the invention have been shown and described, modifications and variations may be made thereto by those of ordinary skill in the art without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is provided by way of example only and is not intended to limit the invention so further described in such appended claims.

What is claimed is:

1. A busbar assembly for use with a conduit box, said busbar assembly comprising:

at least two L-shaped and elongate base elements being situated in parallel to one another and spaced by a predetermined separation;

a terminal support member removably attached and extending across the space between said base elements;

a plurality of standoff busbar units fixedly connected to said terminal support member; and each of said standoff busbar units including an insulative standoff to which a terminal element is attached, said terminal element being configured for attachment of lead wires thereto.

2. A busbar assembly as set forth in claim 1, wherein said terminal support member comprises an elongate support bar having attachment plates located at respective ends thereof.

3. A busbar assembly according to claim 1, wherein said base elements each have a plurality of connection points symmetrically spaced thereon for attachment of said support member.

* * * * *